US005699653A

United States Patent [19]

Hartman et al.

[11] Patent Number: 5,699,653

[45] Date of Patent: Dec. 23, 1997

[54] POUCH MACHINE FOR MAKING MAXIMUM VOLUME POUCH

[75] Inventors: Donn A. Hartman, Gurnee; Charles E. Cloud, Northbrook, both of Ill.

[73] Assignee: Cloud Corporation, Des Plaines, Ill.

[21] Appl. No.: 553,840

[22] Filed: Nov. 6, 1995

[51] Int. Cl.[6] ..... B65B 9/08; B65B 43/36

[52] U.S. Cl. ..... 53/455; 53/385.1; 53/468; 53/562; 493/9

[58] Field of Search ..... 53/468, 469, 455, 53/385.1, 562, 64; 493/20, 19, 9

[56] References Cited

U.S. PATENT DOCUMENTS

| | | | |
|---|---|---|---|
| 3,453,799 | 7/1969 | Cloud et al. | 53/562 X |
| 3,597,898 | 8/1971 | Cloud | 53/385.1 X |
| 3,680,446 | 8/1972 | James et al. | 493/9 |
| 3,700,388 | 10/1972 | Johnson et al. | 53/562 |
| 3,821,873 | 7/1974 | Benner, Jr. et al. | 53/562 X |
| 4,956,964 | 9/1990 | Jones et al. | 53/562 X |
| 5,315,807 | 5/1994 | Restle et al. | 493/9 X |

*Primary Examiner*—James F. Coan
*Attorney, Agent, or Firm*—Dorn, McEachran, Jambor & Keating

[57] ABSTRACT

A pouch machine forms a series of pouches in a continuous web of pouch material by folding the web and then forming spaced side seals to define a pouch closed on three sides with an initially unsealed mouth on top. The pouch is opened to its maximum volume prior to filling by pressurizing the pouch. Pressurization is achieved by introducing a curtain of compressed air under a plate and passing the mouths of the pouches adjacent the plate and thus through the air curtain. The air curtain is preferably at least as wide as the mouth so the entire mouth is subjected to the air pressure, thereby causing the pouch to inflate to its maximum volume. Continuous web height control is provided to assure alignment of the web with the plate. A lip at the mouth may be formed by folding one edge of the pouch over prior to creation of the side seals. After filling the lip is folded back up prior to top sealing to make a balanced pouch. Alternately the lip may be formed by folding the web unevenly so the back panel is higher than the front panel. A plow with driven adjustability provides precise control of folding such that the web can be folded into either a balanced or lipped pouch.

34 Claims, 6 Drawing Sheets

POUCH MACHINE FOR MAKING MAXIMUM VOLUME POUCH

BACKGROUND OF THE INVENTION

This invention relates to a machine and method for continuously forming a series of filled packages or pouches from a continuous strip or web of flexible material. The pouches are commonly used to package a wide variety of products such as sugar, sweeteners, drink mixes, soup mixes and the like in individual or small serving sizes. Liquid products as well as dry products can be packaged in this type of pouch. A variety of web materials can be used such as paper or foil which are relatively stiff and non-extensible or oriented polypropylene or polyester which are somewhat soft and extensible. The web may be coated on at least one side with a heat sealable material such as polyethylene which is suitable for forming heat seals.

An example of a prior art pouch machine is shown in U.S. Pat. No. 3,453,799, the disclosure of which is incorporated herein by reference. The typical pouch machine includes a base supporting various components including an unwind stand for supporting a roll of pouch material. The web is unwound in a generally horizontal plane and advanced to a plow which folds the web generally in half about a longitudinal fold line. The fold line is disposed at the bottom of the web which then assumes a generally V-shape with front and back panels on either side of the fold in a substantially vertical plane.

The folded web is then pulled around a rotary vertical sealer which has a series of vertically extending circumferentially spaced heated lands on its periphery which are provided to form longitudinally spaced, vertically extending heat seals in the web. This sealing process forms pockets or pouches between the front and back panels of the web. The tops of the pouches remain open for filling at a filling wheel which opens the pouches and inserts the desired quantity of the product being packaged. Thereafter, the web is moved to a top sealer which seals the tops. The filled and sealed pouches are transferred to a knife which severs the pouches into individual pouches or groups of pouches.

It will be appreciated that after folding and formation of the side seals, the web is essentially a flat, two-dimensional structure which must be expanded into a three-dimensional form for the pouch to accept the product therein. This has been done in the past by opening the pouch with a jet of air directed to the top of the pouch. The air jet separates the front and back panels at their upper portions but the air jet is not effective to fully open the pouch all the way down to the bottom fold line. If the pouch does not open fully its volume is limited and inserted material tends to congregate near the top edge, making it susceptible to spilling out the top or becoming entrained in the top seal.

The problem of maximizing pouch volume has been addressed in the past by mechanically lifting or tucking the bottom edge of a pouch. An early example of this approach is shown in U.S. Pat. No. 3,667,188. Subsequent efforts to increase pouch volume involved the use of pivotable tucking fingers mounted on the vacuum transfer wheel, as shown in U.S. Pat. No. 4,344,269. The limitations inherent in the tucking finger design became apparent after installation and use of a transfer wheel equipped with tucking fingers. To begin with the mechanical complexity resulted in high up-front engineering and manufacturing costs. Once in operation the dust and particulates from the various products would mix with the natural product oils and moisture and tend to clog the mechanical movements of the tucking fingers. Frequent cleaning was required, much to the annoyance of the operating staff. Normal wear and tear of metal surfaces became a problem. High operating costs inevitably arose from the high level of maintenance required to keep the tucking devices working properly.

Furthermore, in actual practice such devices required a package lip to allow the pouch to be opened by an air jet. A lip results when the top edges of the front and back panels are not co-terminous, i.e., one panel is higher than the other. But lip formation requires a level of folding control which is difficult for the machine operator to achieve. Furthermore, lips are aesthetically unattractive in finished pouches and some packagers will require the removal of the lip after the top seal is made in an effort to satisfy their marketing needs. Thus, there are both lost efficiencies and high costs associated with the methods of production as required by the mechanical tucking machines.

SUMMARY OF THE INVENTION

The present invention addresses the problems of maximizing pouch volume by inflating the pouch with compressed air, resulting in a pouch of a more nearly circular cross section than could previously be obtained. In accordance with the invention the mouth of each pouch is carried into a zone of compressed air which is provided just underneath a rigid plastic or metal plate. Preferably each pouch has a temporary lip. Underneath the plate the thin sheet of compressed air enters the mouth of the pouch through the lip. The top edge of the lip is preferably in contact with the plate to seal off the rear or back side of the pouch, allowing the air pressure to be distributed uniformly along all of the interior surfaces of the pouch. Together the panels of the pouch and the rigid plate define a pressurized chamber. This causes the front and back panels to expand to their maximum capacity and the bottom portion of the pouch to be drawn up into a relatively flat extended surface with a dimple or tuck running across the center from the front panel of the pouch to the rear panel. Such tuck or dimple may take a set which is maintained throughout the spout entry and filling operation. This deformation of the front and rear panels creates a "bottom wall" which allows the pouch to take on a more circular shape as it exits the high pressure zone.

As mentioned, it is preferable that the lip engage the plate so that the air curtain is contained and directed into the interior of the pouch. In order to assure the desired relationship between the lip and plate, it is necessary to control the web height as it enters the pouch opening area. This may be done with a web height control which also forms part of the present invention. The height control comprises a pair of opposed nip rollers between which the web runs with the rollers in contact with the front and back panels. The rollers are mounted for rotation on a bracket which itself pivots about a horizontal axis allowing the rollers to be pitched up or down as needed to adjust the height of the web. A sensor detects the edge of the web and causes an actuator to adjust the bracket as needed to maintain the proper height.

The temporary lip may be formed by a plow or cam disposed downstream of the main folding plow but prior to the vertical heat sealer. If used, the cam folds over a ribbon or tongue of the pouch stock of about 1/32" or more width, preferably on the front panel of the pouch. Since the ribbon or tongue portion is folded down, the heat sealer does not place a vertical seal in the area of the tongue. This is because there is adhesive only on one side of the web (the side normally facing the inside of the pouch) and the heat sealer applies heat from the rear. Thus, the folded ribbon portion is not exposed to side sealing heat, but the adhesive on the ribbon is still operative during top sealing. After filling but before the web enters the top sealer, the tongue is plowed back up by a second plow or cam to its original position. Then the top sealer closes the top edge of the pouch in a balanced package.

A balanced package is one having the same height for the front and rear panels, i.e., there is no overlap at the top edges of the panels, they are co-terminous. In some cases a pouch with a permanent lip may be acceptable and an unbalanced package is made. In either case, the plow must be controlled to locate the fold line in the desired position relative to the edges of the web. But the web does not pay out of the supply roll in a perfectly uniform manner. The width of the web may vary or the edges tend to wander transversely. Thus, positioning the fold line relative to the edges has been a troublesome task that requires frequent operator attention. The present invention includes a plow control which automatically senses lateral web movement then immediately drives the plow to one side or the other to maintain either a predetermined differential in height between the front and rear panels (for a lipped pouch) or maintains a zero differential (for a balanced pouch).

The present invention creates the maximum internal volume capacity possible and is a significant improvement over previous methods as described above in terms of increasing the cross-sectional area of the open pouch. In all cases, with the expanded pouch of the present invention the capacity has been significantly increased over any other known method of maximizing the volume capacity of a pouch. In some instances the volume may be ⅓ greater than with prior devices.

DETAILED DESCRIPTION OF THE INVENTION

I. General Layout of a Pouch Machine

Figure 1:
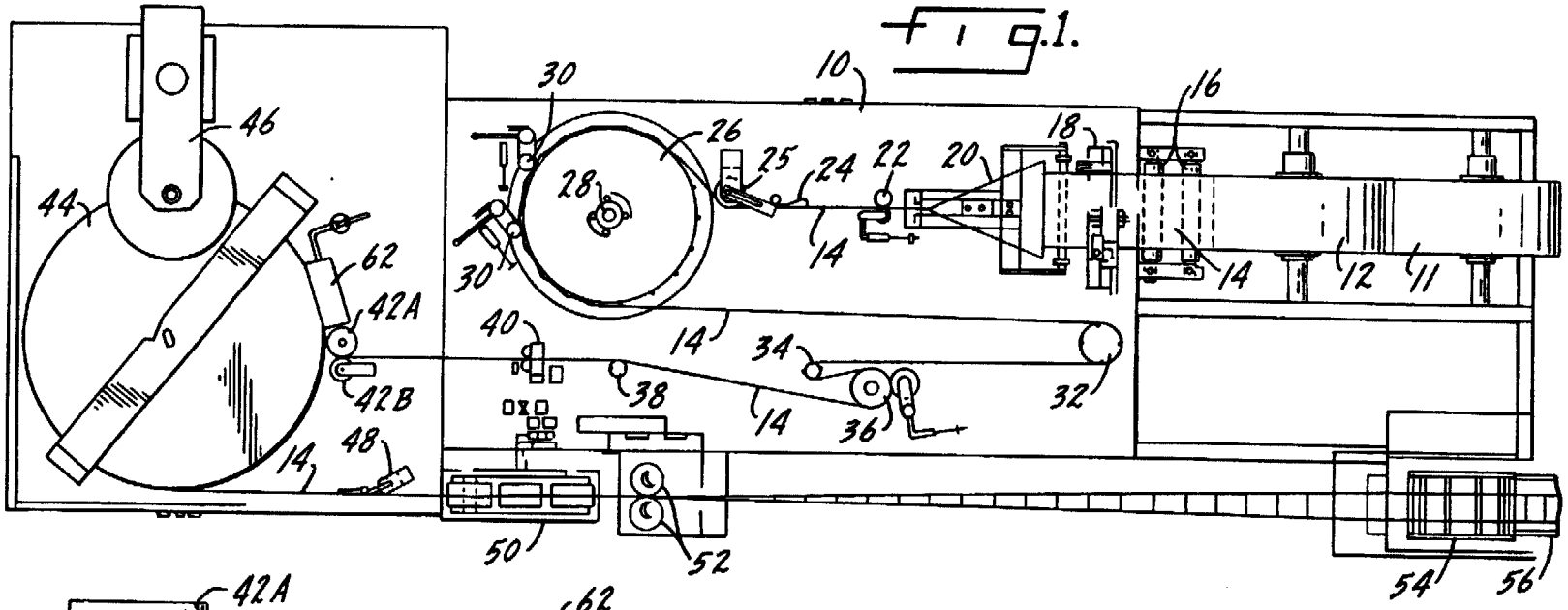
FIG. 1 is plan view of the pouch machine of the present invention.
Figure 5:
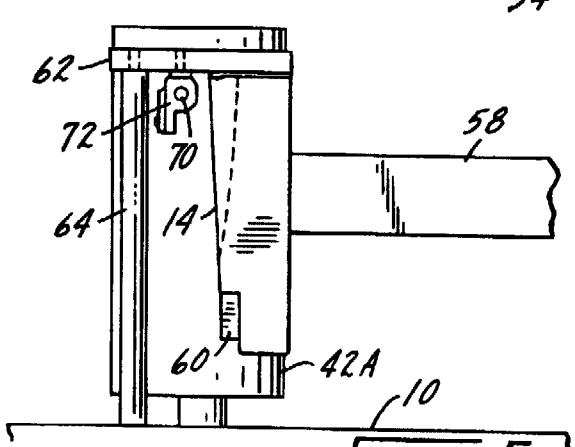
FIG. 5 is a side elevation view of the pouch opening device, looking tangentially of the vacuum transfer wheel.
Figure 4:
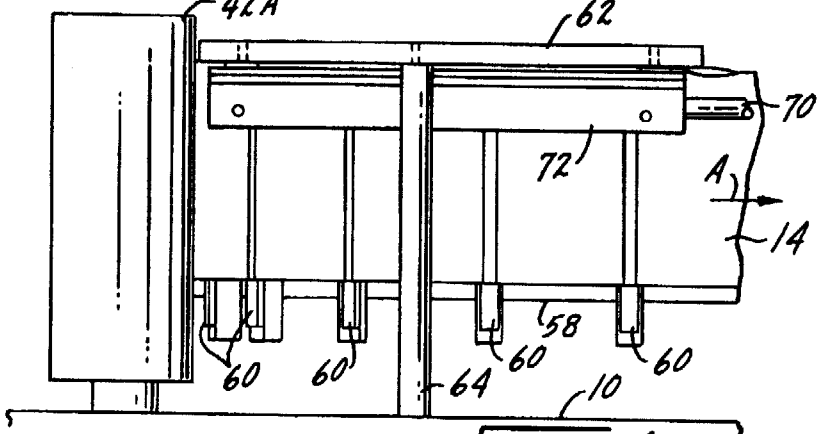
FIG. 4 is a side elevation view of the pouch opening device, looking radially of the vacuum transfer wheel.

A typical pouch machine layout is shown in FIG. 1. The machine includes a base 10 on which the various components of the machine are mounted. Alternately-operable first and second driven unwind stands 11 and 12 play out a continuous web 14 of pouch material in a generally horizontal plane. The unwind stands may include a device known in the art as a dancer (not shown). The dancer accepts the web 14 unwound from the stands 11 or 12 and lets out or takes up slack as needed to maintain proper tension on the web as it moves downstream. From the dancer the web advances to registration rollers 16. A registration scanner 18 reads a registration symbol or mark, sometimes called an eye spot, on the web and adjusts the feed rate of the registration rollers 16 as needed to assure proper longitudinal alignment of the web as it enters the vertical sealer. Lateral alignment of the web is achieved with a driven plow 20 according to the present invention. The plow 20 folds the web up into a vertical plane about a longitudinal fold line which forms the bottom edge of a pouch. Further details of the plow will be described below.

Adjustable guide rollers 22 engage the web at the exit of the plow 20. A folding plow or cam 24 may be provided upstream of the sealer to fold over a ribbon having a width of about an eighth of an inch at the top edge of one panel of the web. This provides a temporary lip which facilitates opening of the pouches as will be set forth hereinafter.

An idler wheel 25 guides the folded web 14 into a rotary vertical heat sealer. The sealer has a sealer wheel 26 mounted on a drive shaft 28. Backup rollers 30 are used to keep the web 14 in contact with heated vertical lands on the periphery of the sealer wheel 26 which form the side seals of the pouches. If a lip has been formed on the pouch it will remain unsealed. First driven feed rollers 36 pull the web of partially-formed pouches around idler rollers 32 and 34. The web then passes around idler 38 and through the web height guide 40 of the present invention before entering the tucking rollers 42 adjacent the filling wheel. The web height guide 40 is described in detail below.

The product feed deck of a filling wheel is shown at 44. It will be understood that beneath the feed deck 44 is a vacuum transfer wheel which, together with the pouch opening device of the present invention, will be described below. The product being packaged in the pouches is supplied to the feed deck by a product feed mechanism 46. The feed mechanism illustrated here is an auger but other types of feeders such as a belt feeder or a metering block and plow could be used depending on the handling characteristics of the product.

After the pouches are filled by the filler wheel, the web 14 passes a lip closing plow 48, if a folded lip is used. Plow 48 plows the ribbon back up to balance the front and back panels of the pouches, leaving a no-lip pouch. Next the web enters a top sealer 50. The top sealer seals the open top edge of the filled pouches. Second driven feed rollers 52 pull the web through the top sealer 50. A squirrel cage 54 may be mounted at the far end of the base 10. The squirrel cage is a driven wheel with transverse rods that gradually rotates the web of completed pouches from a vertical plane to a horizontal plane. The squirrel cage feeds the web onto a conveyor 56 which carries the web to a downstream knife and collation unit which are not shown but are conventional. The knife cuts the web through the side seals to sever the web into finished individual pouches or groups of pouches. The cut pouches are then fed to a suitable collation unit, e.g., a constant motion cartoner. The cartoner packs the pouches into boxes, cartons or the like.

II. Pouch Opening Device for Maximizing Pouch Capacity

The pouch opening device of the present invention is shown in FIGS. 2–5. The web 14 of formed but unfilled pouches is fed by the driven tucker rollers 42A, 42B onto a vacuum transfer wheel 58. The vacuum transfer wheel is mounted below the filling deck of a filling wheel for rotation therewith in the direction of arrow A. A plurality of vertically extending lands 60 are spaced about the periphery of the vacuum transfer wheel 58. The lands 60 engage the side seals of the pouches as is conventional. The lands have vacuum ports therein (not shown) which are connected to a vacuum source to hold the web fixed on the transfer wheel during filling operations. The circumferential spacing of the filler wheel lands 60 is somewhat less than the spacing of the side seals when the web is flat. As the web is fed onto the wheel 58, the tucker rollers 42 overspeed the web somewhat compared to the linear speed of the lands 60. This compresses the web slightly and aligns the side seals with the lands, thereby allowing the pouches to expand when pressurized.

Figure 2:
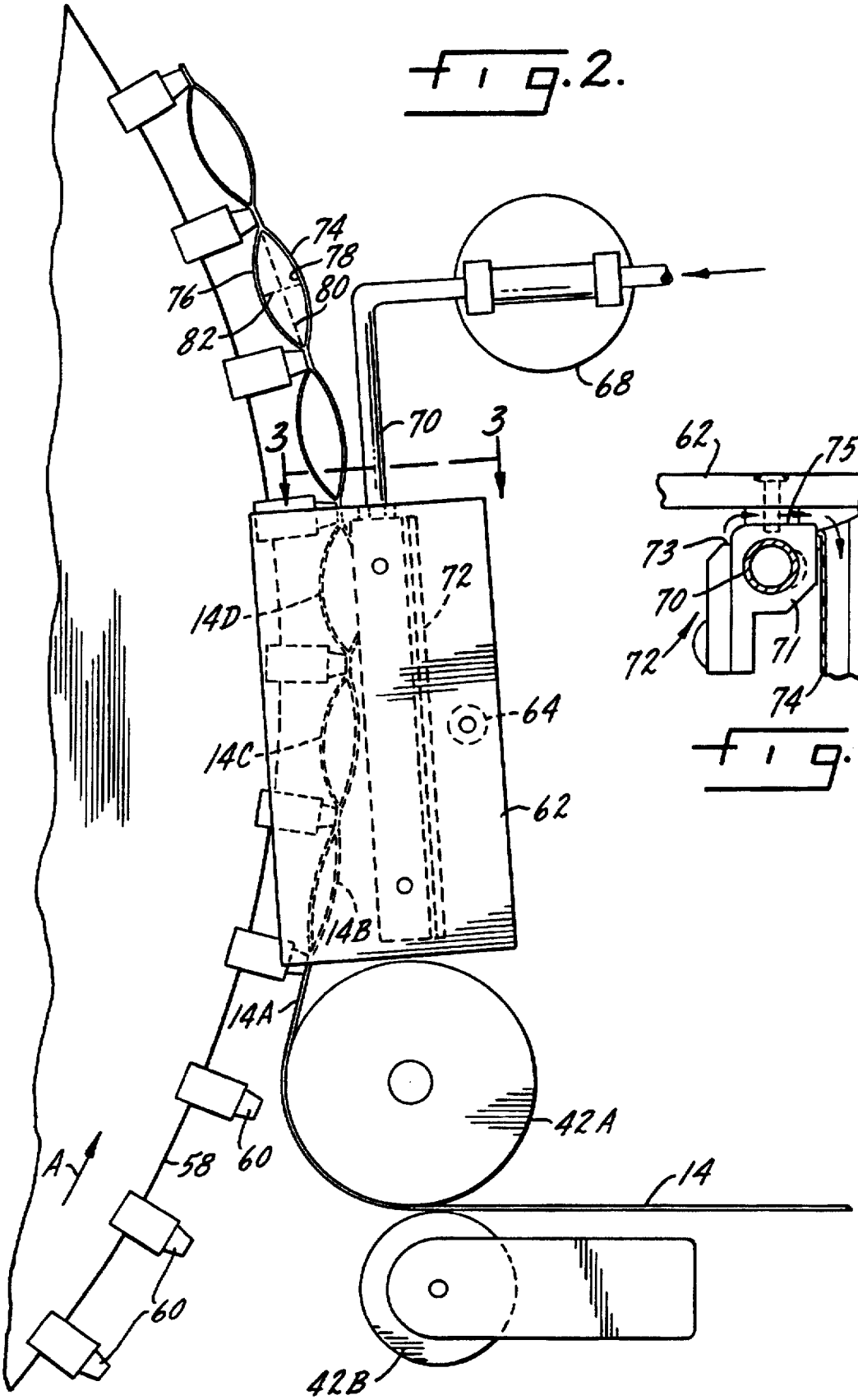
FIG. 2 is a plan view of a portion of a vacuum transfer wheel, showing the pouch opening device of the present invention on an enlarged scale compared to FIG. 1.

The web is fed onto the vacuum transfer wheel underneath a pressure containment means 62. In the preferred embodiment, the containment means is a flat plate, preferably formed of metal or plastic. The plate shown in FIG. 2 is a transparent plastic, such as Lexan, a trademark of DuPont. A post 64 is fixed to the base 10 to support the plate 62. The plate is rectangular. One corner of the plate is located near the intersection of tucker roller 42A and the outer portions of the lands 60. This area defines an entry point where the web transfers from the tucker roller to the vacuum transfer wheel.

Figure 3:
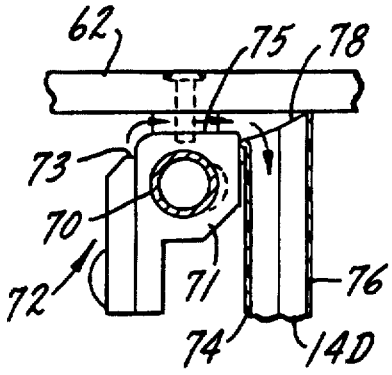
FIG. 3 is a side elevation view of the air delivery case, on an enlarged scale, looking in the direction of line 3—3 of FIG. 2.

An air delivery system operating in conjunction with the plate 62 includes a source of compressed air supplied through a filter and moisture trap 68. The air supply is at about 60 to 100 psi. A tube 70 supplies air from trap 68 to an air delivery case 72. The case 72 is bolted to the underside of the plate 62. Details of the case 72 are shown in FIG. 3. Compressed air flows through tube 70 into a plenum chamber 71. It is then throttled through a slit opening or nozzle shown at 73 which extends the length of the case 72. The nozzle opening is a few thousandths of an inch and is adjustable. The air flow out the nozzle 73 adheres to the profile of the face 75 of the case, thus turning the air stream 90° and directing it to flow down the face of the unit. This primary air stream immediately begins to entrain surrounding air while velocity loss is minimized through the wall attachment effect. The result is a high velocity, high volume sheet of air. A suitable air delivery case is available from Exair Corporation of Cincinnati, Ohio, under their trademark Exair-Knife.

The air delivery case creates a curtain of pressurized air just underneath the surface of the plate 62. This air curtain is wider than the space between successive lands on the transfer wheel. This means there is a time period in which the entire mouth of a pouch is simultaneously exposed to a zone of high pressure. As a result, the pouch interior is subjected to air pressure of a great enough magnitude to cause the pouch to open or inflate fully. This is shown in FIG. 2 where a pouch 14A at the entry point is fully closed or flat while pouch 14B is partially open, pouch 14C is open somewhat more and the pouches shown at 14D and beyond are fully open.

It will be noted that each pouch has a front panel 74 and a rear panel 76 defining a mouth 78 at the top of the pouch. The mouth can be considered to have a major axis 80 and a minor axis 82. The maximum volume pouch is obtained when the major axis and minor axis are equal, i.e., when the pouch forms a cylindrical tube. However, to form a closed cylindrical tube it is clear that something must serve as the horizontal bottom wall of the cylinder. Given the flat, folded condition of the web at the outset, the only pouch material available for forming a bottom wall is actually the lower portion of the front and rear panels. So, to make a cylindrical pouch, portions of these lower front and rear panels have to be bent around a corner to serve the role as the bottom of the cylinder. Given the nature of the side seals and bottom fold, this can only be done by forming a transverse dimple or tuck in the bottom of the pouch. With the structure shown in FIGS. 2–5 the tuck can be formed with the air pressure contained underneath the plate 62.

As the highly pressurized air passes into the interior of the pouch it is distributed uniformly over all interior surfaces. This internal pressure causes the minor axis of the oval shaped pouch to increase and more nearly equal the major axis so that the cross-sectional shape of the pouch approaches a circle. As the minor axis of the pouch increases, the bottom section of the tube is drawn apart with the expansion of the side walls. As this bottom portion of the tube expands, its center rises toward the middle section of the pouch creating a dimple or tuck running across the center from the front panel to the rear panel. This deformation of the side walls and bottom portion of the pouch is now set into a more circular shape as it exits the temporary, highly pressurized chamber and remains so set as the filling spout enters the nearly circular pouch and the charge of product flows into the expanded bottom and up the expanded side walls. Because of the expanded state of the pouch the product will be positioned lower in the pouch in relation to the top seal thus allowing for a product-free top seal. In all cases, with this deformed, expanded pouch "tube", the volume capacity has been significantly increased and there is greatly improved uniformity from pouch to pouch in the opening over any other known method of increasing the volume capacity of a pouch.

It can be seen that pressurizing a pouch requires that the air curtain and pouch be constrained so that the air curtain inflates the pouch and is not just dissipated to atmosphere. As used herein a "contained" pouch is one in a position to be affected by the pressure containment means. Although the plate 62 has been found to be an effective pressure containment means, other techniques of containment could be used. For example, a cam surface could initially pinch the mouth closed around a moving pressurizing tube that extends into the pouch to inflate it, after which the air is allowed to escape and open the mouth. Or a traveling lid could be applied to each pouch to close it temporarily during inflation.

The expansion or inflation step is described herein as resulting in separation of "substantially all unsealed portions of the front and back panels" from one another. It will be understood that this terminology is meant to encompass a situation where some minor portion of the front and back panels, other than at the side seals, may still be in contact. This is most likely to occur at the bottom corners, i.e., the junction between the side seals and the fold line. Of course, the panels will always contact each other at the side seals. In general, separation of "substantially all unsealed portions of the front and back panels" will mean there is a tuck in the pouch extending transverse to the fold line, although some softer pouch materials may not take a set tuck or even create a tuck at all.

III. Web Height Guide

It can be seen that the volume maximizing apparatus just described requires the air curtain to be contained and not simply diffused to atmosphere. The pressure containment means or plate 62 serves the function of containing the air curtain but it is also required that the web be maintained at a given height in relation to the plate. Thus, it is preferred that the web be in contact with the underside of the plate. More particularly, the most effective results are obtained when a lip is formed on the web panel farthest from the air delivery case 72, i.e., the rear panel. This lip should ride just barely in contact with the underside of the plate to seal off the rear or back side of the pouch. With the lip so arranged a slot is defined at the mouth which allows the air pressure to enter the pouch and be distributed along the interior surfaces of the pouch.

Figure 6:
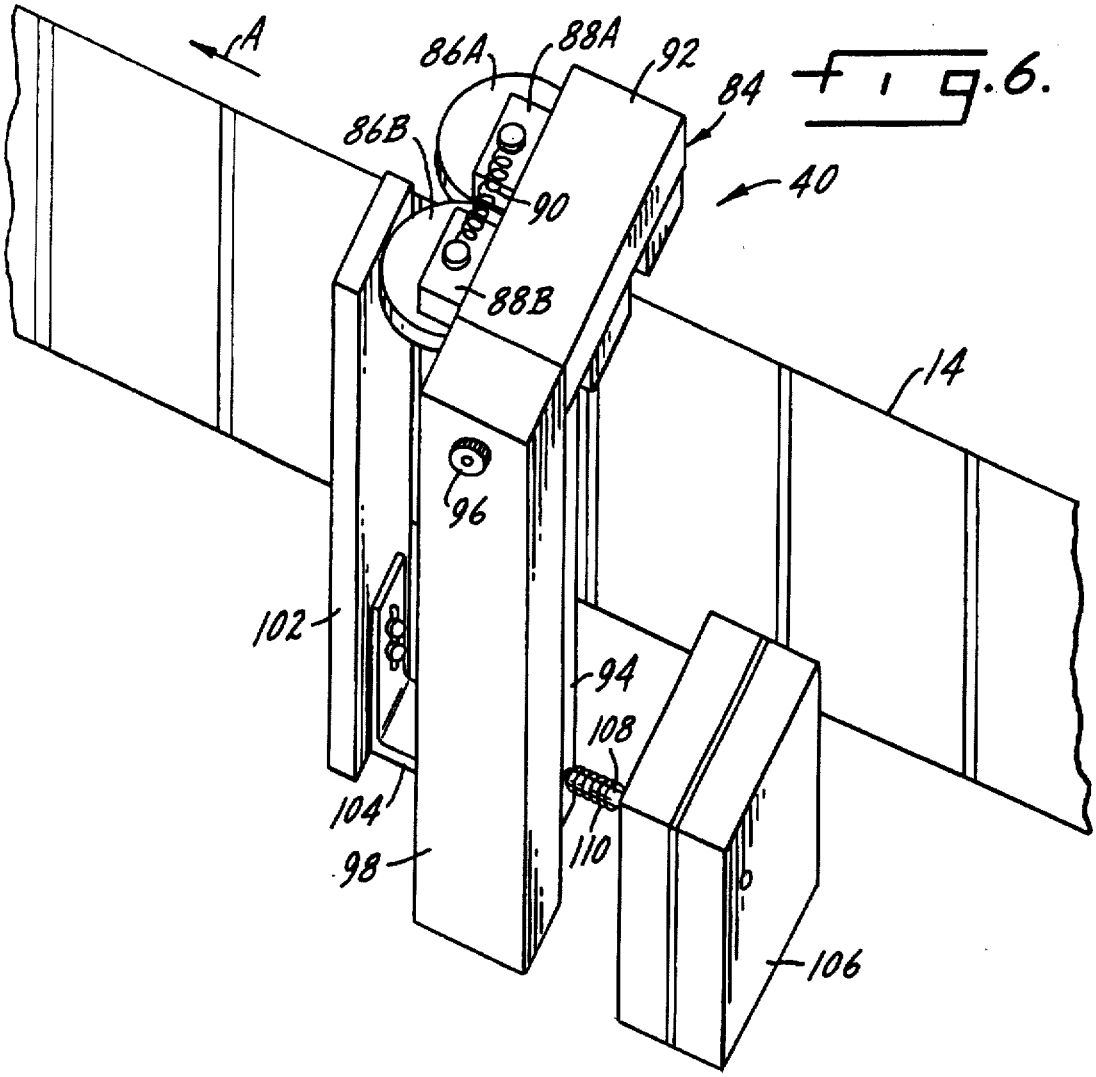
FIG. 6 is a perspective view of the web height control.
Figure 7:
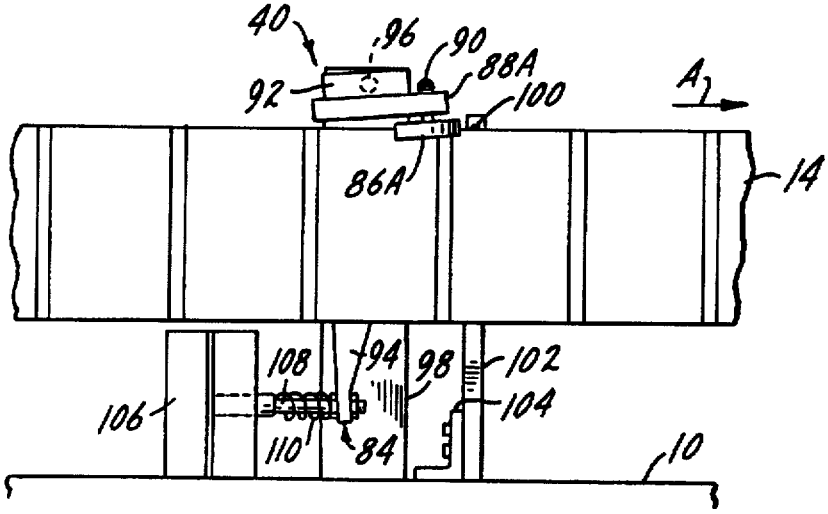
FIG. 7 is a side elevation view of the web height control.
Figure 8:
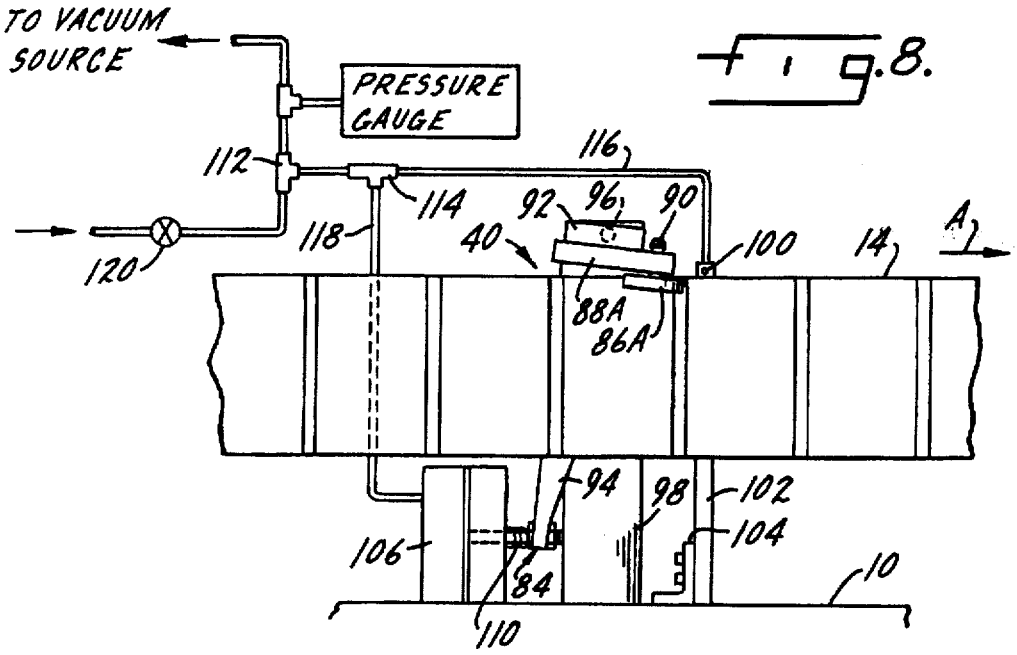
FIG. 8 is a view similar to FIG. 7 with the height control in a moved position.

An adjustable web height guide system for maintaining the pouch at the proper height to accomplish this purpose is shown in FIGS. 6–8 at 40. The guide includes a pair of opposed nip rollers 86A, 86B each of which is mounted for rotation on its own arm 88A, 88B. The arms 88 are adjustably mounted on a bracket 84 such that a spring 90 can place the rollers 86 in compression to engage the web 14 running between the rollers. The bracket 84 includes a horizontal cantilevered portion 92 and a depending leg portion 94. The bracket is pinned as at 96 to an upstanding support 98.

Immediately downstream of the nip rollers 86 is a sensor port 100 mounted in or on a post 102. The post is bolted to an angle bracket 104 which is fixed to the base 10. The bracket 104 has a vertical slot for receiving the post bolts such that the height of the post can be adjusted.

A vacuum diaphragm 106 is fixed to the base 10 and has a rod 108 connected to the diaphragm and bolted to the leg 94 of bracket 84. A compression spring 110 urges the bracket leg 94 away from the housing of the vacuum diaphragm.

A suitable vacuum circuit is shown in FIG. 8. It includes a vacuum source connected through T-connectors 112, 114 and line 116 to the sensor port 100. The left side of the vacuum diaphragm 106, as seen in FIG. 8, is connected to the vacuum source through line 118 and T-connector 114. The right side of the diaphragm chamber is vented to atmosphere. The circuit also includes a bleed valve 120 connected to T-connector 112. A pressure gauge may be included as shown.

The operation of the web height guide is as follows. The post 102 is adjusted on bracket 104 so that sensor port 100 is at the exact height desired for the uppermost edge of the web. The web shown in FIG. 8 is running below the port opening 100. Thus, in FIG. 8 the web is running too low and needs to be raised. With the web too low the entire port 100 is exposed to atmosphere which partially relieves the vacuum in the left diaphragm chamber. The pressure in the left chamber goes up. This increase in left chamber pressure, together with the spring 110, pushes the diaphragm and rod 108 to the right. This in turn moves bracket leg 94 to the right, causing the bracket to pivot about pin 96 and raise the arms 88 and nip rollers 86 toward the position shown in FIG. 7. The nip rollers cause the web to increase in height and cover a portion of the opening of port 100.

If the port 100 is entirely closed by the web running too high, the vacuum source will lower the pressure on the left side of the vacuum diaphragm.. The relative increase in right chamber pressure pushes the diaphragm to the left, carrying the threaded rod 108 with it. This causes a clockwise rotation of the bracket 84 about pin 96, thereby lowering the web height. When the chamber pressures of the vacuum diaphragm are in equilibrium the web will cover approximately half of the opening of port 100.

An alternate construction for the vacuum circuit is possible. By adding a line from the bleed valve 120 to the right side of the vacuum diaphragm and deleting the spring 110, a balanced vacuum could be applied to both sides of the diaphragm. In this construction if a differential vacuum is created by the covering or uncovering of the port hole 100 by the web, the differential would cause motion of the diaphragm and bracket holding the nip rollers tending to correct the web height so that it again covers about half of the port.

IV. Driven Plow Controls

As mentioned above, it is preferred that the pouches have a lip as they enter the vacuum transfer wheel. A lip can be thought of as an unbalanced package, i.e., the front or rear panel has a slightly greater height than the other panel so that it overlaps the panel somewhat. This lip is anywhere from 1/32" to 3/16" or so. Preferably the lip is formed on the rear panel 76 as seen in FIG. 2. It is this lip that the height guide of FIGS. 6–8 controls to contact the underside of the pressure containment plate. With the lip engaging the plate there is a slot of between 1/32" and 3/16" through which the high pressure air enters the pouch.

Formation of the lip can be accomplished by controlling the location of the fold line at the plow 20. If the fold line is located offset from the center of the web as it comes off its supply roll, a lip will be formed. However, control of the fold location has been a problem due to transverse motion of the web caused by non-uniform winding of the material on the supply roll or due to other inaccuracies in the means for feeding the web to the plow. A floating plow for handling this situation is shown and described in U.S. Pat. No. 3,398,656, the disclosure of which is incorporated herein by reference. This device provides a plow which is pivotally connected to the base 10 so that it can pivot back and forth. It is accurate within about 1/16" but that is not accurate enough for the purposes of this invention or for the aesthetics some customers demand for their pouches. Accordingly, it has been found necessary to include a positive drive and control for the plow which continuously adjusts the plow position according to the location of the incoming web.

Figure 9:
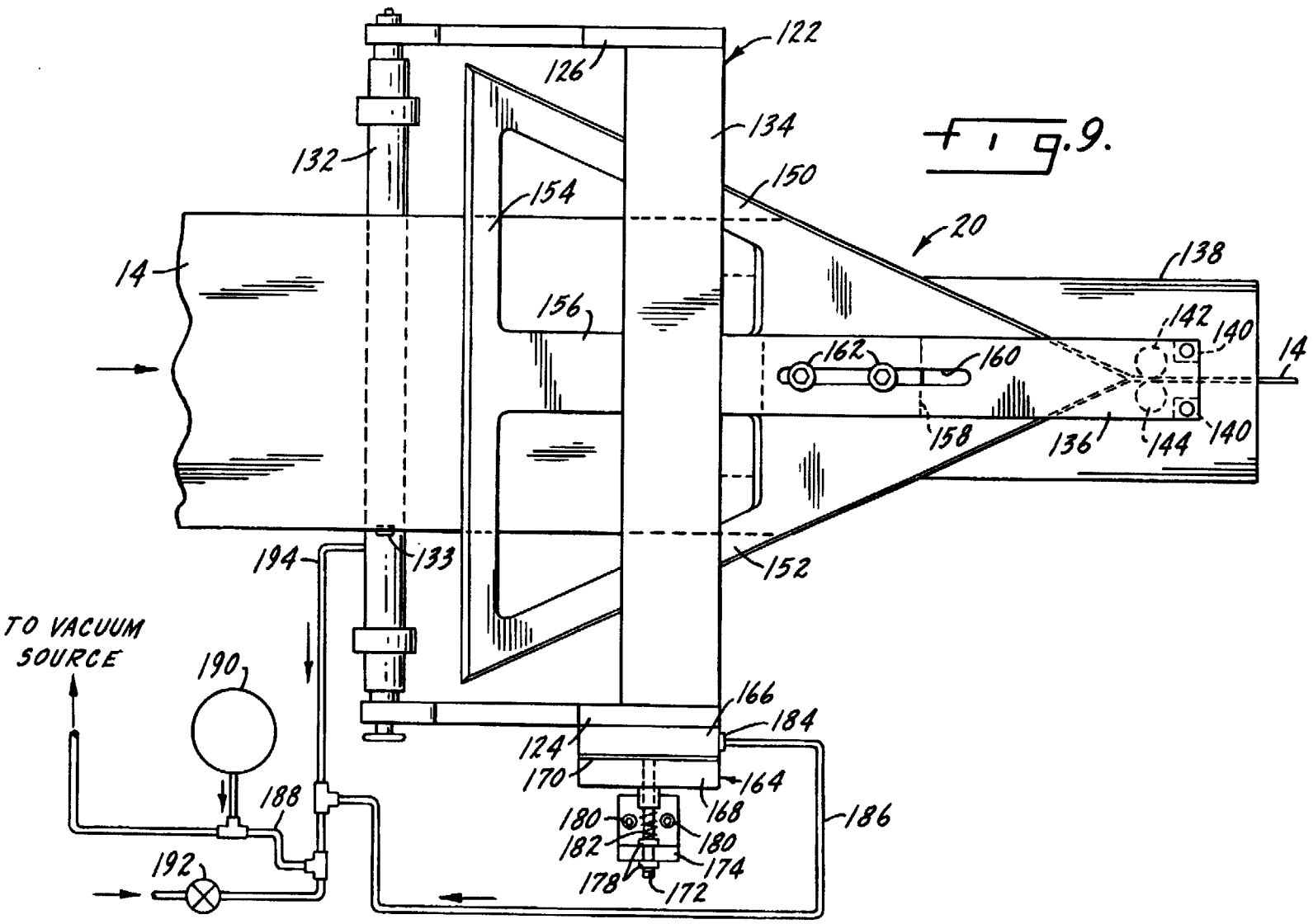
FIG. 9 is a plan view of the plow of the present invention.
Figure 10:
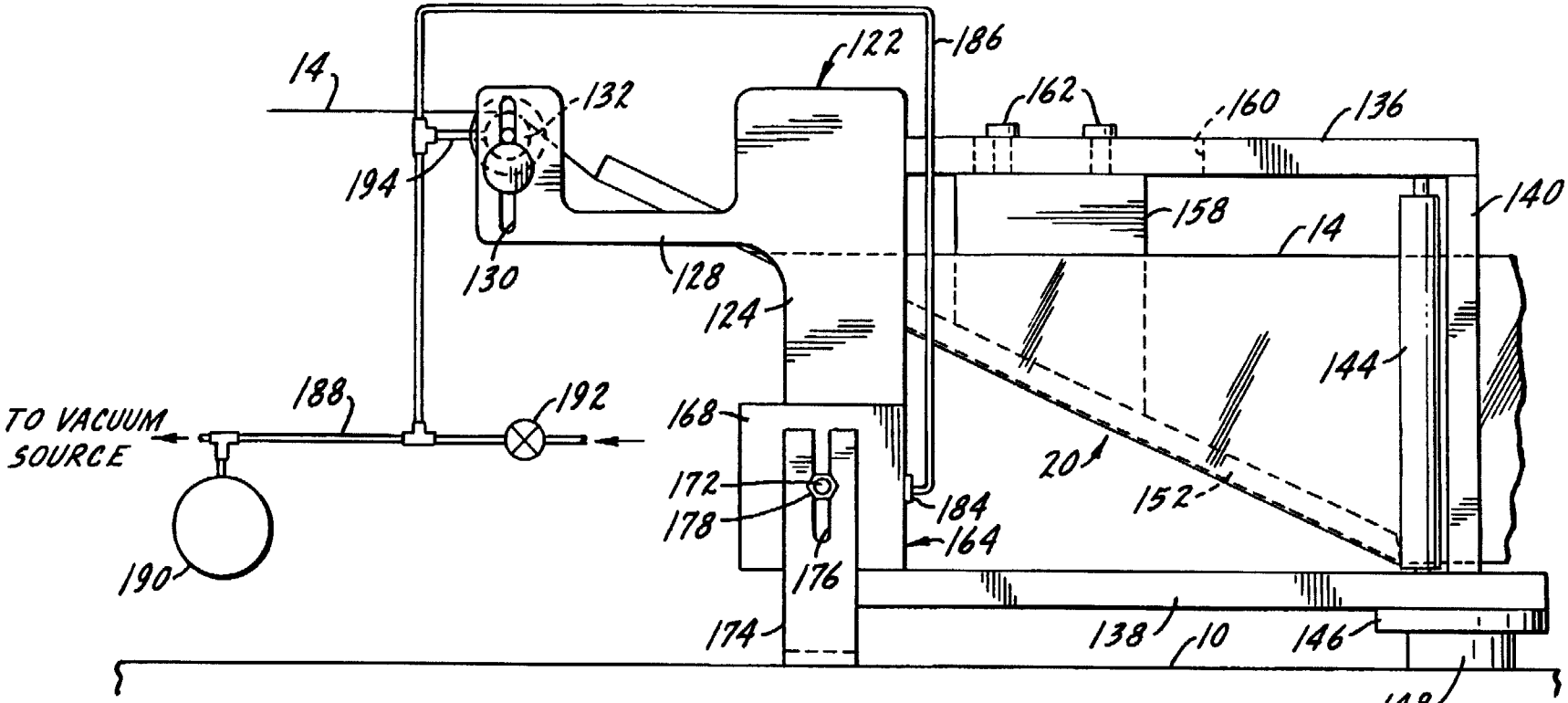
FIG. 10 is a side elevation view of the plow.

The plow is mounted on a frame shown generally at 122 in FIGS. 9 and 10. The frame includes a pair of side carriage plates 124, 126. Each carriage plate has a cantilevered arm 128 which has a slot 130 for adjustably mounting a guide shaft 132. The guide shaft has a slot 133 cut in the upper surface thereof. The slot is about 1/16" wide and 1/4" long. The shaft 132 is preferably made of stainless steel. It is hollow at least in the vicinity of the slot 133 so the slot opens into the hollow interior of the shaft. The carriage plates 124, 126 are joined by upper and lower transverse members, the upper member being visible at 134 in FIG. 9. The lower member is hidden but it will be understood that it is similar to the member 134 and joins the lower edges of the carriage plates 124, 126.

An upper longitudinal beam 136 extends forwardly from transverse member 134 to the front of the plow. A similar lower longitudinal beam 138 is fixed to the lower transverse member and extends forwardly to a post 140. The post supports the upper beam 136. A pair of rollers 142 and 144 are rotatably mounted adjacent the post 140 for creasing or setting the fold in the web as it comes off the plow. The lower longitudinal beam 138 rests on a spacer 146 which in turn is supported on a shaft 148. The shaft is rotatably connected to the base 10. The height of the frame 122 can be adjusted at 146 and 148 as needed.

The plow itself is a triangular member having two legs 150, 152, a base 154 and a central web 156. The legs converge at a forming edge which creates the fold line in the web. The plow is supported by a plate 158 which is bolted to the upper longitudinal beam 136 and to the central web 156 of the plow. A slot 160 in the beam 136 allows adjustable connection by means of bolts 162.

The plow is driven by an actuator 164 such as the vacuum diaphragm shown. The actuator has a housing defining chambers 166 and 168 therein on either side of a diaphragm 170. The actuator 164 includes a rod 172 which is fixed at its inner end to the diaphragm 170. The outer end of the rod 172 is threaded and fixed to an angle bracket 174. The outer end extends through a slot 176 in bracket 174 where it is held by nuts 178. The angle bracket is fixed to the base 10 by bolts 180. A spring 182 is in compression between the upright portion of the bracket and the housing of the vacuum diaphragm. The other side of the housing is attached to the carriage plate 124.

A port 184 in the actuator housing is connected to a vacuum line 186. Line 186 is connected to a vacuum source on line 188 between a pressure gauge 190 and a bleed valve 192. Branching off line 186 is a vacuum line 194 which is in communication with the hollow portion of the shaft 132, thus connecting the slot 133 to the vacuum source.

The operation of the plow is as follows. The web 14 of pouch material runs in a horizontal plane over the guide shaft 132 and under the base 154 of the plow. The edges of the web fold up around the legs 150, 152 such that the web exits the plow between the rollers 142, 144 in a substantially vertical plane.

An edge of the web extends just to the point of the slot 133 and it is desired that the web edge bisect the slot such that half of it is covered and half of it is open. When non-uniformity of the web coming off of the supply roll alters this desired condition, the actuator 164 responds to pivot the plow about the shaft 148, thereby keeping the tip of the plow in the correct relation to the edges of the web.

With the illustrated vacuum circuit, the rod 172 holds the diaphragm 170 fixed. It is the housing that moves when lateral movement of the web alters the pressure balance in the housing chambers. The housing movement will increase the size of one of the chambers 166, 168 while decreasing the size of the other. For example, if the web shifts to the top of FIG. 9 the slot 133 is opened, thereby reducing the vacuum in chamber 166, i.e., the pressure in the chamber goes up. This increased pressure, together with the spring force pushes the actuator housing to the top of the page. This in turn pushes the frame 122 to the top and carries the plow in a direction which compensates for the shift in the web position. Similarly, when the web moves downwardly in FIG. 9 the slot 133 is closed off thereby increasing the vacuum in chamber 166, i.e., the pressure in the chamber is reduced. The atmospheric pressure in chamber 168 is then relatively higher and it will push the housing downwardly. This movement in turn causes the frame 122 and plow to move and compensate for the shift in the web position.

As is the case with the web height control of FIGS. 6–8, the vacuum circuit could be altered such that both chambers 166 and 168 have vacuum applied. The bleed valve 192 would be connected to chamber 168 and the spring 182 would be deleted. In a further alternate control circuit, positive air pressure could be used instead of the vacuum. The same slot 133 and pneumatic circuit as shown would be used but air would be blowing out of the slot instead of being drawn in. This may be preferable with some web materials and/or inks used thereon to prevent clogging of the slot.

It can be seen that the plow control of the present invention maintains the tip of the plow at the chosen location relative to the edges of the web. This location may be offset from the center to create a permanent lip in the web or it could be exactly on center in which case there is no lip formed. Some customers want a package with no lip and no slitting required after top sealing to achieve the balanced package.

V. Temporary Lip Formation Device

Figure 11:
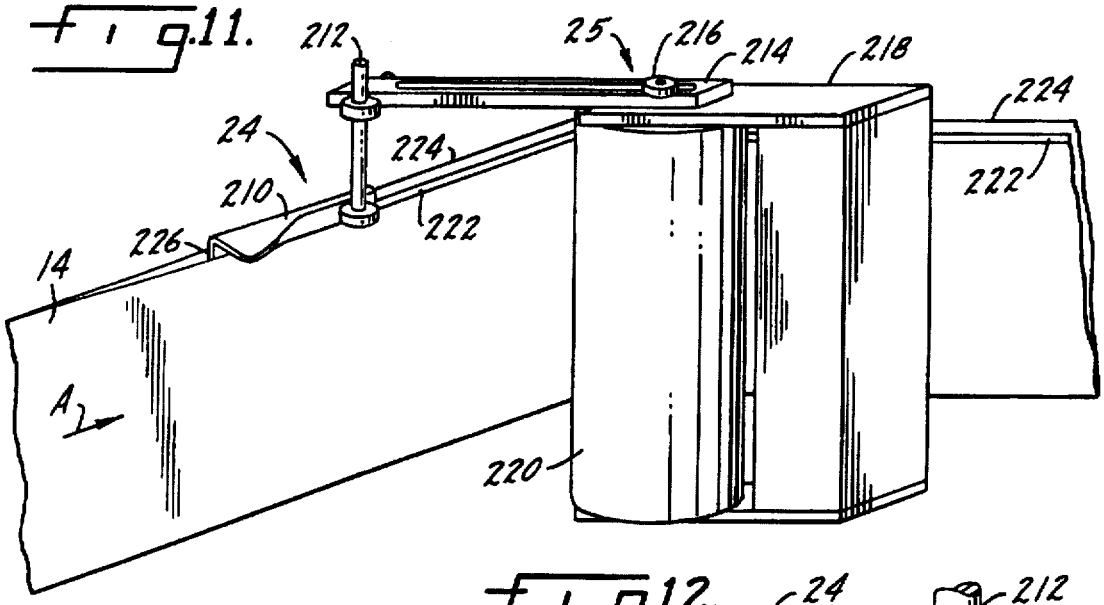
FIG. 11 is a perspective view of the lip forming device of the present invention.
Figure 12:
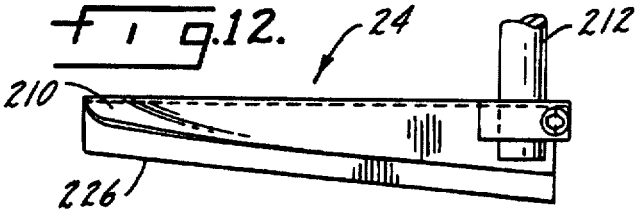
FIG. 12 is a side elevation view of the lip forming plow.

The present invention provides a way to produce a lipless package which has a temporary lip for use during the pouch opening phase of the present invention. FIGS. 11 and 12 show a lip forming device 24 for this purpose. It has a ribbon forming plow or cam 210 supported between the web panels by a rod 212 which is itself carried in a slotted bar 214. The bar is connected by bolt 216 to a housing 218 of the idler wheel assembly 25. The housing rests on the base 10 adjacent the web upstream of the side sealer. The housing can include a roller 220 for creasing down the ribbon 222 after it has been folded over by the plow 210. The plow surface includes a separator finger 226 extending between the panels. The finger joins a gradually curving surface 228 which acts on the front panel of the web, gradually curling it over to form the ribbon 222. The ribbon has a width of about ⅛". With the ribbon folded over, the back panel forms a lip as at 224. This lip remains after side sealing and is still there as the web enters the pouch opening device described above.

A second plow or cam unit 48 is placed downstream of the filler wheel (see FIG. 1) and prior to the top sealer 50. At the unit 48 the plow surface is arranged to fold or plow the ribbon 222 back up so the panels have a co-terminous top edge as the web enters the top sealer. In other words the pouch is balanced after leaving plow unit 48. After top sealing, there is no lip on the web. This arrangement permits the benefits of a lip for pouch opening while providing a finished pouch that is balanced.

While a preferred form of the invention has been shown and described, it will be realized that alterations and modifications may be made thereto without departing from the scope of the following claims. For example, while both the web height guide and the driven plow are shown pivotally mounted for adjusting the position of the web, a linear sliding motion could also be used to effect the change in web position. Alternative sensors for detecting web positions in both the height guide and driven plow could be substituted for the vacuum ports shown. Thus, electrical or mechanical sensors could be used. And the vacuum diaphragms could be replaced with alternate actuating devices for the purpose of altering the web position. Also, while it is preferred that the pouches have a lip, at least temporarily, when they enter the pouch opening device, with some materials it may be possible to have balanced pouches at the opening device. Similarly, while contact between the pouch and plate 62 seems to work best, some applications may allow a slight separation and still produce satisfactory results. Further, while the air curtain shown and described is the preferred structure for introducing air into the pouch, other arrangements are possible.

We claim:

1. In a pouch machine of the type which forms a series of pouches in a web of pouch material, the pouches being defined by front and back panels with side seals and a closed bottom, the tops of the pouches prior to filling being open to define a mouth, the improvement comprising means for opening the pouches to their maximum volume prior to filling, comprising pressure containment means for temporarily restricting air flow in the vicinity of the mouth of a pouch, and pressurizing means for introducing air into a contained pouch to generate an internal pouch pressure high enough to separate substantially all unsealed portions of the front and back panels from one another.

2. The pouch machine of claim 1 wherein the internal pouch pressure is high enough to create a tuck in the bottom of the pouch.

3. The pouch machine of claim 1 wherein the pressurizing means includes air delivery means for creating a curtain of pressurized air in the path of the pouch mouths, the curtain having a width such that the entire mouth of the pouch is exposed at one time to a zone of high pressure air.

4. The pouch machine of claim 1 wherein the pressure containment means comprises a flat plate aligned with the uppermost edge of the front or back panel.

5. The pouch machine of claim 4 wherein the pressurizing means includes air delivery means for creating a curtain of pressurized air adjacent the flat plate and in the path of the pouch mouths, the curtain having a width such that the entire mouth of the pouch is exposed at one time to a zone of high pressure air.

6. The pouch machine of claim 4 further comprising means for forming a lip at the mouth of the pouches.

7. The pouch machine of claim 6 wherein the lip forming means comprises a plow for folding over an upper edge of one of the panels.

8. The pouch machine of claim 6 wherein the lip forming means comprises a plow for folding the web material about a bottom fold line to form the front and back panels, and means for controlling the position of the fold line to make one panel slightly higher than the other to create the lip.

9. The pouch machine of claim 8 wherein the means for controlling the position of the fold line comprises a frame pivotable about an axis, the plow being mounted on the frame for pivoting about said axis, means for sensing the web position as it approaches the plow and an actuator for pivoting the frame in response to the sensed position to adjust the plow position relative to the web as needed to locate the fold line in a prescribed position relative to the edges of the web.

10. The pouch machine of claim 9 wherein the actuator is a vacuum diaphragm and the means for sensing is a port past which an edge of the web runs with a vacuum line connected between the port and diaphragm such that deviation of the web from the port causes actuation of the diaphragm countering the deviation.

11. The pouch machine of claim 4 further comprising a web height control for feeding the web into the flat plate at the prescribed position relative to the flat plate.

12. The pouch machine of claim 11 wherein the web height control comprises a pair of nip rollers guiding the web therebetween, the nip rollers being mounted for rotation in a bracket which is pivotable about a horizontal axis, means for sensing the web height, and an actuator for pivoting the bracket in response to the sensed height to adjust the web up or down as needed to maintain it at a prescribed height.

13. The pouch machine of claim 12 wherein the actuator is a vacuum diaphragm and the means for sensing is a port past which an edge of the web runs with a vacuum line connected between the port and diaphragm such that deviation of the web from the port causes actuation of the diaphragm countering the deviation.

14. A filler wheel for a rotary pouch machine of the type which forms a series of pouches in a web of pouch material, the pouches being defined by front and back panels joined by side seals and a closed bottom, the tops of the pouches prior to filling being open to define a mouth, comprising:

a vacuum transfer wheel mounted for rotation and having a plurality of lands on its periphery for receiving and temporarily fixing thereto the side seals of the web of pouches fed into the transfer wheel at an entry point; and air delivery means for creating a curtain of pressurized air in the path of the pouch mouths downstream of the entry point, the curtain having a width such that the entire mouth of the pouch is exposed at one time to a zone of high pressure air.

15. The filler wheel of claim 14 further comprising pressure containment means for temporarily restricting air flow in the vicinity of the mouth of a pouch at the air curtain such that as the mouth opens the air curtain will generate an internal pouch pressure high enough to separate substantially all unsealed portions of the front and back panels from one another.

16. The filler wheel of claim 15 wherein the pressure containment means has a shape that will accommodate transformation of the pouch from a flat, essentially two-dimensional shape to an expanded, three-dimensional shape.

17. The filler wheel of claim 15 wherein the pressure containment means comprises a flat plate aligned with the uppermost edge of the front or back panel.

18. The filler wheel of claim 17 wherein the flat plate is fixedly mounted adjacent the vacuum transfer wheel.

19. In a pouch machine of the type which forms a series of pouches in a web of pouch material, the pouches being defined by front and back panels joined by side seals and a closed bottom, the tops of the pouches prior to filling being open to define a mouth, an improved method of opening the pouches to their maximum volume prior to filling, comprising the step of:

subjecting the full extent of the mouth of a pouch at one time to a zone of compressed air thereby pressurizing the pouch to an internal pressure high enough to separate substantially all unsealed portions of the front and back panels from one another.

20. The method of claim 19 further comprising the step of temporarily restricting air flow in the vicinity of the mouth of a pouch prior to subjecting the pouch to the zone of compressed air.

21. In a pouch machine of the type which forms a series of pouches in a web of pouch material, the pouches being defined by front and back panels joined by side seals and a closed bottom, the tops of the pouches prior to filling being open to define a mouth, an improved method of opening the pouches to their maximum volume prior to filling, comprising the steps of temporarily restricting air flow in the vicinity of the mouth of a pouch and then pressurizing the pouch to an internal pressure high enough to separate substantially all unsealed portions of the front and back panels from one another.

22. In a rotary pouch machine of the type which forms a series of pouches in a moving web of pouch material, a web position control apparatus comprising guide means in supporting engagement with the moving web, the guide means including a pair of nip rollers guiding the web therebetween, the nip rollers being mounted for rotation in a bracket which is movable in a direction transverse to the web, means for sensing the web position, and an actuator for moving the bracket in response to the sensed position to cause the guide means to adjust the web position as needed to maintain it at a prescribed location.

23. The pouch machine of claim 22 wherein the actuator is a vacuum diaphragm and the means for sensing is a port past which an edge of the web runs with a vacuum line connected between the port and diaphragm such that deviation of the web from the port causes actuation of the diaphragm countering the deviation.

24. The pouch machine of claim 22 wherein the bracket is pivotable about an axis and the actuator pivots the bracket about said axis.

25. In a pouch machine of the type which forms a series of pouches in a web of pouch material, the pouches being defined by front and back panels joined by side seals and a closed bottom, the tops of the pouches prior to filling being open to define a mouth, an improved method of filling the pouches comprising the steps of:

forming a lip in the top edge of one panel by folding a portion of said top edge down such that said panel has a smaller height than the other panel;

directing compressed air at the mouths of the pouches to separate the front and back panels, thereby opening the pouches for filling;

filling the pouches with a product;

removing the lip by folding it back up to its original position; and sealing the top edges of the pouches.

26. A rotary pouch machine, comprising:

a base including a web supply stand for paying out a web of pouch material having side edges;

a plow adjustably mounted on the base downstream of the web supply stand and having a forming edge about which the web of pouch material is folded to define a longitudinal fold line in the web;

a lateral position sensor for detecting deviation of the web from a desired lateral position relative to the plow's forming edge; and a plow actuator connected between the base and the plow, the actuator being responsive to the lateral position sensor for driving the plow's forming edge in a direction counteracting any lateral deviation of the web so as to maintain the fold line in a selected position intermediate the edges of the web.

27. The pouch machine of claim 26 further comprising a frame pivotable about an axis, the plow being mounted on the frame for pivoting about said axis.

28. The pouch machine of claim 26 wherein the actuator is a vacuum diaphragm and the lateral position sensor is a port past which an edge of the web runs with a vacuum line connected between the port and diaphragm such that deviation of the web from the port causes actuation of the diaphragm countering the deviation.

29. The pouch machine of claim 27 wherein the lateral position sensor is mounted on the frame.

30. The pouch machine of claim 26 wherein the plow is pivotally mounted on the base.

31. In a rotary pouch machine of the type having a base including a web supply stand for paying out a web of pouch material having side edges, and a plow adjustably mounted on the base downstream of the web supply stand and having a forming edge about which the web of pouch material is folded to define a longitudinal fold line in the web, an improved method of controlling the location of the fold line relative to the side edges, comprising the steps of:

detecting deviation of the web from a desired lateral position relative to the plow's forming edge; and driving the plow's forming edge in a direction counteracting any lateral deviation of the web so as to maintain the fold line in a selected position intermediate the edges of the web.

32. In a pouch machine of the type which forms a series of pouches in a web of pouch material, the pouches being defined by front and back panels joined by side seals and a closed bottom, the tops of the pouches prior to filling being open to define a mouth, the improvement comprising means for forming a lip at the mouth comprising a plow engageable with the top edge of one of the panels prior to formation of the side seals, the plow being arranged to fold a portion of said top edge down such that said panel has a smaller height than the other panel.

33. The pouch machine of claim 32 wherein the plow includes a separator finger disposed between the front and back panels.

34. The pouch machine of claim 32 further comprising means for removing the lip after filling of the pouches including a second plow for plowing said folded portion of the top edge back up to its original unfolded position.

* * * * *